US006756021B2

(12) United States Patent
Botrel

(10) Patent No.: US 6,756,021 B2
(45) Date of Patent: Jun. 29, 2004

(54) DEVICE FOR ELIMINATING GAS OR PARAFFIN HYDRATE DEPOSITS THAT FORM IN WELL DRILLING EQUIPMENT OR IN HYDROCARBON PRODUCTION OR TRANSPORTATION EQUIPMENT

(75) Inventor: Thierry Botrel, Pau (FR)

(73) Assignee: Elf Exploration Production, Paris La Defence (FR)

( * ) Notice: Subject to any disclaimer, the term of this patent is extended or adjusted under 35 U.S.C. 154(b) by 724 days.

(21) Appl. No.: 09/769,269

(22) Filed: Jan. 26, 2001

(65) Prior Publication Data

US 2002/0153140 A1 Oct. 24, 2002

(30) Foreign Application Priority Data

Jan. 28, 2000 (FR) ..... 00 01107

(51) Int. Cl.[7] ..... E21B 37/06
(52) U.S. Cl. ..... 422/184.1
(58) Field of Search ..... 422/171, 173, 422/177, 178, 184.1, 198, 200, 202, 204, 211, 212, 222, 223

(56) References Cited

U.S. PATENT DOCUMENTS

| | | | | |
|---|---|---|---|---|
| 2,349,536 A | | 5/1944 | Bancroft | |
| 2,639,774 A | | 5/1953 | Rhoads | |
| 3,693,719 A | * | 9/1972 | Sample et al. | 166/304 |
| 4,011,906 A | * | 3/1977 | Alexander et al. | 166/105 |
| 4,294,803 A | * | 10/1981 | Uchida et al. | 422/111 |
| 4,446,917 A | | 5/1984 | Todd | |
| 4,456,069 A | | 6/1984 | Vigneri | |
| 4,720,263 A | | 1/1988 | Green | |
| 4,896,725 A | * | 1/1990 | Parker et al. | 166/267 |
| 4,911,240 A | | 3/1990 | Haney et al. | |
| 4,933,089 A | * | 6/1990 | Newton | 210/696 |
| 5,365,006 A | * | 11/1994 | Serrand | 585/501 |
| 5,656,136 A | | 8/1997 | Gayaut et al. | |
| 6,656,366 B1 | * | 12/2003 | Fung et al. | 210/737 |

FOREIGN PATENT DOCUMENTS

GB 2 172 683 9/1986

OTHER PUBLICATIONS

XP 002151947 Abstract of Russian Patent No. 2109127, No Date.
French Search Report dated Nov. 3, 2000.

* cited by examiner

*Primary Examiner*—Samuel M. Heinrich
(74) *Attorney, Agent, or Firm*—Sughrue Mion, PLLC

(57) ABSTRACT

The invention relates to a device for the elimination of gas or paraffin hydrate deposits that form in well drilling equipment or hydrocarbon production and transportation equipment through the use of a reactant that is likely to decompose at high temperatures.

The device consists of: an annular decomposition chamber (1) mounted in a sealed manner around a section of said piping (2), where said chamber contains a catalyst (3) that promotes the decomposition of said reactant, a reservoir for the reactant (4) that feeds said decomposition chamber with the reactant so as to heat the hydrate and paraffin deposits (9) through the heat that emanates from the decomposition of the reactant by the catalyst, an output tube (11) for the evacuation of the products that result from the decomposition of the reactant outside the decomposition chamber, and means for injecting (13, 14) a flushing fluid under pressure inside the decomposition chamber in order to carry said products that result from the decomposition toward the output tube.

10 Claims, 2 Drawing Sheets

DEVICE FOR ELIMINATING GAS OR PARAFFIN HYDRATE DEPOSITS THAT FORM IN WELL DRILLING EQUIPMENT OR IN HYDROCARBON PRODUCTION OR TRANSPORTATION EQUIPMENT

TECHNICAL FIELD OF THE INVENTION

This invention relates to a device for eliminating gas or paraffin hydrate deposits that form inside drilling equipment or hydrocarbon production or transportation equipment. The device as set forth in the invention can be applied in the oil industry, in particular in the extraction at sea of liquid or gaseous hydrocarbons at great depths, and in the transportation of these hydrocarbons.

STATUS OF THE PRIOR ART

A device for eliminating the paraffin or bitumen deposits that form on the inside wall of piping, for example in tubular equipment located in the center of an oil production well or in an oil transportation pipe-line, is described in the Russian patent RU 2 109 127. This device, mounted inside the piping, contains a heat generator, mechanical means for cleaning the piping wall and means for moving along the piping. The heat generator consists of a reacting liquid with an exothermic decomposition reaction. This liquid is stored in a reservoir that is connected, via a valve, to a reactor and to a decomposition chamber. The decomposition chamber is equipped with ducts through which jets of gaseous products from the decomposition of the reacting liquid are ejected while the heat generator is operating. These jets heat the paraffin or bitumen deposits that are present on the inside wall of the piping.

However, this device has the disadvantage of only being able to operate by stopping the circulation of hydrocarbons inside the piping. Furthermore, it must be moved using a drive means, for example using a cable, which considerably limits the field of application.

Through U.S. Pat. No. 4,456,069, we know of a device intended to increase the temperature and the pressure inside a well bore in order to increase the permeability of the formation located at the bottom of the well. This device is located at the head of the well and consists of a gas generator in which a reactant is decomposed by a catalyst to form very hot decomposition gases and of an air compressor to inject compressed air into the well. But, such a device is not suited to the elimination of gas and paraffin hydrate slugs that settle on the wall of the hydrocarbon transportation pipes that can be several kilometers in length and be submerged at great depths on the sea floor.

DISCLOSURE OF THE INVENTION

The object of this invention is to remedy these disadvantages and therefore to propose a device for the elimination of gas or paraffin hydrate deposits that form on the inside wall of hydrocarbon production or transportation pipes, through the use of a reactant that is likely to decompose when high temperatures are produced and where said device is characterized by the fact that it consists of:

an annular decomposition chamber mounted in a sealed manner around a section of said piping, where said chamber consists of a catalyst that promotes the decomposition of said reactant, a reservoir for the reactant that feeds said decomposition chamber with said reactant so as to heat the hydrate and paraffin deposits using the heat that emanates from the decomposition of the reactant by the catalyst, an output tube (11) for the evacuation of the products that result from the decomposition of the reactant outside the decomposition chamber, and means of injection (13, 14) of a flushing fluid under pressure inside the decomposition chamber in order to carry said products that result from the decomposition toward the output tube.

The reactant is chosen from the group consisting of hydrogen peroxide, hydrazine and ethylene oxide.

The catalyst can be a solid catalyst chosen from the group consisting of a metal oxide, iron, platinum and silver. This catalyst can be deposited on a ceramic support. The catalyst can also be a liquid catalyst chosen from the group that contains iron nitrate and iron sulfate.

According to another characteristic, the device of the invention also consists of means for injecting a liquid additive into the decomposition chamber in order to facilitate the initiation of the decomposition reaction of the reactant.

According to another characteristic of the invention, the inside wall of the reactant's decomposition chamber is lined with a material that resists high temperatures.

BRIEF DESCRIPTION OF THE DRAWINGS

The invention will be better understood when using the following descriptions in reference to the attached drawings where.

DETAILED DESCRIPTION OF THE PREFERRED METHODS OF EXECUTION

The device as set forth in the invention relates to the elimination of gas or paraffin hydrate deposits in drilling equipment or hydrocarbon production or transportation equipment through the production of heat through the decomposition of a reactant such as hydrogen peroxide, hydrazine or ethylene oxide.

Figure 1:
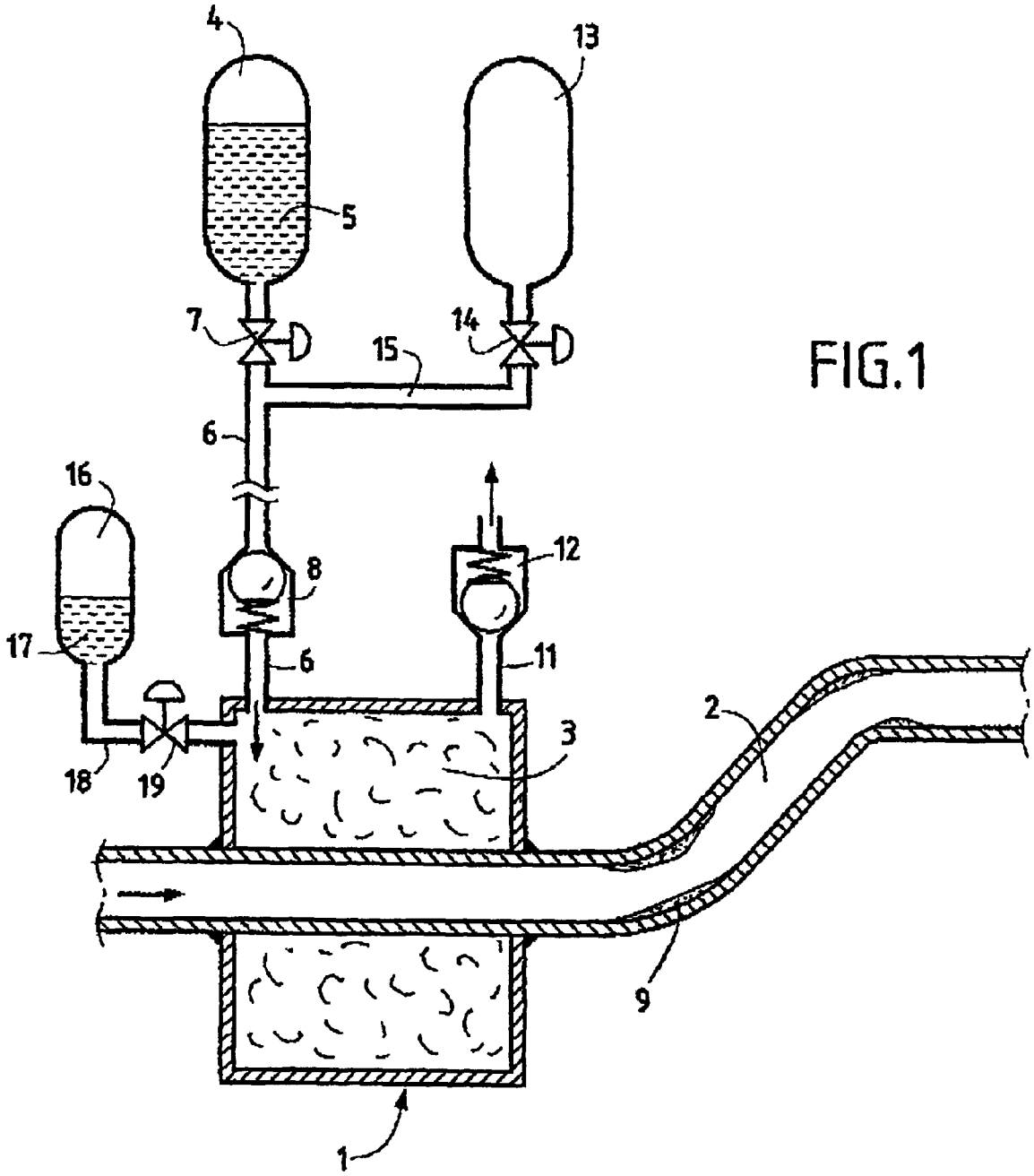
FIG. 1 schematically represents a first method of execution of the device for the elimination of gas or paraffin hydrate deposits in a hydrocarbon transportation conduit.

FIG. 1 schematically represents a first method of execution of the device as set forth in the invention. This device consists of a decomposition chamber 1 mounted in a sealed manner around a pipe 2 for the transportation of a mix of liquid and gaseous hydrocarbons. The decomposition chamber 1 is filled with a catalyst 3 that promotes the decomposition of the reactant. The catalyst can be in the form of silver foam.

The device also consists of means for supplying reactant consisting of a reservoir 4 that contains a reactant 5. The reservoir is linked through a tube 6 to the decomposition chamber 1 via a valve 7 with an adjustable opening and a check valve 8.

To eliminate the gas or paraffin hydrate deposits 9 that are present on the inside wall of the piping 2, the valve 7 is progressively opened so as to inject reactant into the decomposition chamber 1. Upon contact with the catalyst 3, the reactant decomposes producing a large amount of heat. This heat heats the mix of hydrocarbons that circulate in the piping 2 through the wall of the pipe. The hydrocarbons then heat and dissolve the deposits 9 that are located downstream from the section of the piping on which is mounted the decomposition chamber 1.

The amount of heat brought to the hydrocarbons in circulation is regulated by adjusting the opening of the valve 7 over a period of time that is more or less long.

The gaseous products of the decomposition of the reactant cannot move upward in the tube 6 toward the reservoir 4 because of the entry check valve 8. They are partially evacuated outward through an output tube 11 connected to the upper part of the decomposition chamber 1, and consisting of an output check valve 12.

The device of the invention also consists of means for injecting a flushing fluid, such as nitrogen, to eliminate the products resulting from the decomposition of the reactant from the decomposition chamber 1. These means for injecting a flushing fluid consist of a storage bulb that contains a flushing fluid under pressure. This bulb is connected to the tube 6 downstream from the valve 7 by a tube 15 through an admission valve 14 with an adjustable opening.

After injecting the reactant in the decomposition chamber 1, the valve 7 is closed and the valve 14 is opened to allow the passing of a flow of the flushing fluid inside the chamber 1. The flushing fluid carries the residual products from the decomposition of the reactant.

The device of the invention also consists of means for injecting a liquid additive such as iron nitrate, into the decomposition chamber 1 to facilitate or accelerate the decomposition reaction of the reactant. The means for injecting the additive consist of a storage bulb 16 that contains an additive 17 under pressure.

The bulb is connected to the decomposition chamber 1 by a tube 18 through an injection valve 19 with an adjustable opening. The means for injecting the liquid additive are particularly useful when the device of the invention is used under strong hydrostatic pressure.

To initiate the decomposition reaction of the reactant we can also simultaneously inject a flushing fluid into the reactant in order to create a volume of gas in the decomposition chamber that will facilitate the expansion of the oxygen that is liberated by the decomposition reaction of the reactant.

To limit the volumes of the reactant injected in the case of very long pipes, we can use the flushing fluid as a fluid that will push the reactant.

Figure 2:
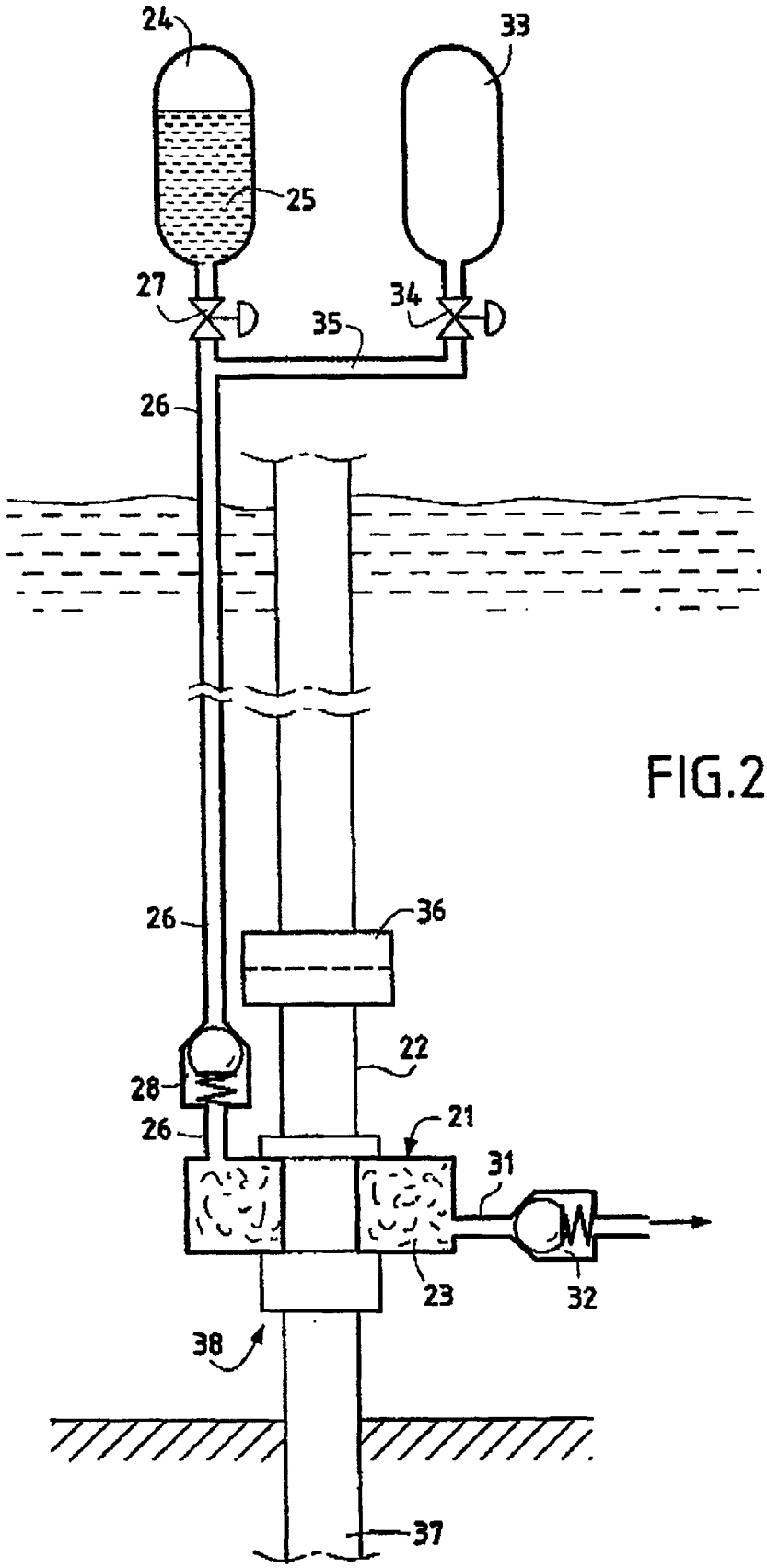
FIG. 2 schematically represents a second method of execution of the device in a hydrocarbon production offshore well head.

FIG. 2 schematically represents a second method of execution of the device as set forth in the invention. This device consists of a decomposition chamber 21 mounted in a sealed manner around a riser pipe 22 that connects the head 28 of a hydrocarbon production underwater well 37 at the surface of the ocean. The riser pipe consists of a blowout preventor 36. The decomposition chamber 21 is filled with a catalyst 23 that promotes the decomposition reaction.

The device also has means for feeding reactant that consist of a reservoir 24 that contains a reactant 25. The reservoir is connected by a tube 26 to a decomposition chamber 21 through a valve 27 with an adjustable opening and a check valve 28.

To eliminate the gas or paraffin hydrate deposits that are present on the inside wall of the riser pipe 22 and the equipment mounted downstream from the device, the valve 27 is progressively opened so as to inject reactant into the decomposition chamber 21. When in contact with the catalyst 23, the reactant decomposes producing a large quantity of heat. This heat heats the hydrocarbons that circulate in the piping 22, through the wall of the piping. The hydrocarbons heat and dissolve the gas or paraffin hydrate deposits that are downstream from the part of the piping 22 on which is mounted the decomposition chamber 21.

The product resulting from the decomposition of the reactant is stopped from heading back up toward the reservoir 24 by the check valve 28. They are partially evacuated by an output pipe 31 through an output check valve 32.

The device in FIG. 2 also consists of means for injecting a flushing fluid such as nitrogen. These means for injection consist of a storage bulb 33 for the flushing fluid under pressure. This bulb is connected to the tube 26 downstream from the valve 27 by a tube 35 through an admission valve 34 with an adjustable opening.

Thanks to the device a set forth in the invention, the gas or paraffin hydrate deposits can be eliminated from the walls of hydrocarbon production equipment, in particular at great ocean depths, without disrupting production.

Another advantage of the device of the invention is the simplicity of its assembly and design that make it very reliable.

What is claimed is:

1. Device for the elimination of the gas or paraffin hydrate deposits that form on the inside wall of hydrocarbon production or transportation pipes through the use of a reactant that is likely to decompose at high temperatures where said device is characterized by the fact that it consists of:

an annular decomposition chamber (1) mounted in a sealed manner around a section of said pipe (2), where said chamber contains a catalyst (3) that promotes the decomposition of said reactant, a reservoir for the reactant (4) that feeds said decomposition chamber with reactant, so as to heat the paraffin and hydrate deposits (9) through the heat that emanates from the decomposition of the reactant by the catalyst, an output tube (11) for the evacuation of the products that result from the decomposition of the reactant outside the decomposition chamber, and means for injecting (13, 14) a flushing fluid under pressure inside the decomposition chamber in order to carry said products that result from the decomposition toward the output tube.

2. Device as set forth in claim 1, characterized by the fact that the reactant is chosen from the group that contains hydrogen peroxide, hydrazine and ethylene oxide.

3. Device as set forth in claim 1, characterized by the fact that the catalyst (3) is solid and is chosen from the group that consists of a metal oxide, iron, platinum and silver.

4. Device as set forth in claim 3, characterized by the fact that solid catalyst is deposited on a ceramic support.

5. Device as set forth in claim 4, characterized by the fact that the catalyst is liquid and is chosen from the group that contains iron nitrate and iron sulfate.

6. Device as set forth in claim 1, characterized by the fact that it also consists of means (16, 18, 19) for injecting a liquid additive (17) into the decomposition chamber (1) to facilitate the initiation of the decomposition reaction of the reactant.

7. Device as set forth in claim 1, characterized by the fact that the flushing fluid is nitrogen.

8. Device as set forth in claim 1, characterized by the fact that the reactant's reservoir is connected to the decomposition chamber (1) by an entry tube (6) through an adjustable admission valve (7) and an entry check valve (8).

9. Device as set forth in claim 1, characterized by the fact that the output tube (11) contains an output check valve (12).

10. Device as set forth in claim 1, characterized by the fact that the inside wall of the decomposition chamber (1) is lined with a material that resists high temperatures.

* * * * *